US010124986B2

(12) United States Patent
Kondo

(10) Patent No.: US 10,124,986 B2
(45) Date of Patent: Nov. 13, 2018

(54) ELEVATOR CONTROL DEVICE FOR MAXIMIZING A NUMBER OF FLOORS SERVICED

(71) Applicant: MITSUBISHI ELECTRIC CORPORATION, Chiyoda-ku (JP)

(72) Inventor: Shingo Kondo, Tokyo (JP)

(73) Assignee: MITSUBISHI ELECTRIC CORPORATION, Chiyoda-ku (JP)

( * ) Notice: Subject to any disclaimer, the term of this patent is extended or adjusted under 35 U.S.C. 154(b) by 382 days.

(21) Appl. No.: 14/890,526

(22) PCT Filed: Jul. 10, 2013

(86) PCT No.: PCT/JP2013/068879
§ 371 (c)(1),
(2) Date: Nov. 11, 2015

(87) PCT Pub. No.: WO2015/004753
PCT Pub. Date: Jan. 15, 2015

(65) Prior Publication Data
US 2016/0122156 A1 May 5, 2016

(51) Int. Cl.
*B66B 9/00* (2006.01)
*B66B 1/24* (2006.01)
(Continued)

(52) U.S. Cl.
CPC ..... *B66B 1/2433* (2013.01); *B66B 5/0031* (2013.01); *B66B 9/00* (2013.01);
(Continued)

(58) Field of Classification Search
CPC ..... B66B 1/2433; B66B 5/0031; B66B 9/00; B66B 1/468; B66B 3/02; B66B 2201/301
(Continued)

(56) References Cited

U.S. PATENT DOCUMENTS 5,877,462 A * 3/1999 Chenais ..... B66B 5/0031 187/249
7,389,857 B2 * 6/2008 Hikita ..... B66B 1/2466 187/249
(Continued)

FOREIGN PATENT DOCUMENTS

JP 2003-081542 A 3/2003
JP 2007-055692 A 3/2007
(Continued)

OTHER PUBLICATIONS

International Search Report dated Sep. 24, 2013 in PCT/JP13/68879 Filed Jul. 10, 2013.

*Primary Examiner* — Anthony Salata
(74) *Attorney, Agent, or Firm* — Oblon, McClelland, Maier & Neustadt, L.L.P.

(57) ABSTRACT

An elevator controller that enables enhancement in serviceability, avoids a collision between multiple cars that ascend/descend inside a common shaft, and suppresses increase in the number of floors a car cannot reach. The elevator controller includes: multiple cars arranged inside a common shaft such that each car can ascend/descend independently; an occupied area setting mechanism setting, for each of the multiple cars, a maximum area of a travel section necessary for the car to make an emergency stop as an occupied area for the car based on a running speed, a running direction, and a call registration status; and a running speed setting mechanism setting a running speed of a car so a number of floors the car can service is maximized within a range in which the car can make an emergency stop without entering an occupied area set by the occupied area setting mechanism for the other car.

7 Claims, 2 Drawing Sheets

(51) Int. Cl.
*B66B 5/00* (2006.01)
*B66B 1/46* (2006.01)
*B66B 3/02* (2006.01)

(52) U.S. Cl.
CPC ..... *B66B 1/468* (2013.01); *B66B 3/02* (2013.01); *B66B 2201/301* (2013.01)

(58) Field of Classification Search
USPC ..... 187/247, 249, 288, 293, 296, 297, 391, 187/393, 394, 380–388
See application file for complete search history.

(56) References Cited

U.S. PATENT DOCUMENTS 7,448,471 B2 * 11/2008 Nuebling ..... B66B 1/28 187/249
7,650,966 B2 * 1/2010 Sansevero ..... B66B 1/2466 187/249
7,987,947 B2 * 8/2011 Christy ..... B66B 1/468 187/249
8,136,635 B2 * 3/2012 Christy ..... B66B 5/0031 187/249
8,348,018 B2 * 1/2013 Kostka ..... B66B 3/02 187/249
8,424,651 B2 * 4/2013 Brand ..... B66B 5/0031 187/249
8,434,599 B2 * 5/2013 Wang ..... B66B 5/0031 187/249
8,584,813 B2 * 11/2013 Talonen ..... B66B 1/468 187/391
9,096,410 B2 * 8/2015 Iwata ..... B66B 5/024
9,650,226 B2 * 5/2017 Jacobs ..... B66B 1/24
9,708,158 B2 * 7/2017 Kakio ..... B66B 5/02

FOREIGN PATENT DOCUMENTS

JP 2007-223767 A 9/2007
JP 2008-063017 A 3/2008
JP 4086565 5/2008

* cited by examiner

ELEVATOR CONTROL DEVICE FOR MAXIMIZING A NUMBER OF FLOORS SERVICED

TECHNICAL FIELD

This invention relates to an elevator control device.

BACKGROUND ART

As an elevator including multiple cars that bi-directionally run inside one shaft, one in which upon issuance of a request from a car, a restriction section that may restrain the car from running therein is determined based on a position, a running direction, a service direction, an operating speed, a call generation status or an emergency fall distance of another car, and the car, running of which may be restrained by the other car, is determined as a car to be restrained, and if the car to be restrained is located outside the restriction section, an entry prohibition instruction is provided to the car to be restrained is known (see, for example, Patent Literature 1).

CITATION LIST

Patent Literature

Patent Literature 1: Japanese Patent No. 4086565

SUMMARY OF INVENTION

Technical Problem

As described above, in the technique indicated in Patent Literature 1, in order to avoid interference between cars in a common shaft, a restriction section is set. However, because the setting of the restriction section limits the operation areas of the respective cars, there arise floors a car cannot reach. In particular, where the running speeds of the cars are high, the braking distances are long, resulting in expansion of the restriction section. Accordingly, the number of floors a car cannot reach increases, resulting in substantial decrease in serviceability.

This invention has been made in order to solve such problem, and is intended to provide an elevator control device that enables enhancement in serviceability by, while avoiding a collision between multiple cars that ascend/descend inside a common shaft, suppressing increase in the number of floors a car cannot reach.

Means for Solving the Problems

An elevator control device according to the present invention includes: multiple cars arranged inside a common shaft in such a manner that each car can ascend/descend independently; occupied area setting means configured to set, for each of the multiple cars, a maximum area of a travel section necessary for the car to make an emergency stop as an occupied area for the car, based on a running speed, a running direction and a call registration status; and running speed setting means configured to set a running speed of a car so that a number of floors the said car can service is maximized within a range in which the said car can make an emergency stop without entering the occupied area set by the occupied area setting means for another car.

Advantageous Effects of Invention

An elevator control device according to this invention exerts the effect of enabling enhancement in serviceability by, while avoiding a collision between multiple cars that ascend/descend inside a common shaft, suppressing increase in the number of floors a car cannot reach.

BRIEF DESCRIPTION OF THE DRAWINGS

FIG. 1 is a figure schematically illustrating an overall configuration of an elevator including an elevator control device related to Embodiment 1 of the present invention.

DESCRIPTION OF EMBODIMENT

Embodiment 1

Figure 1:
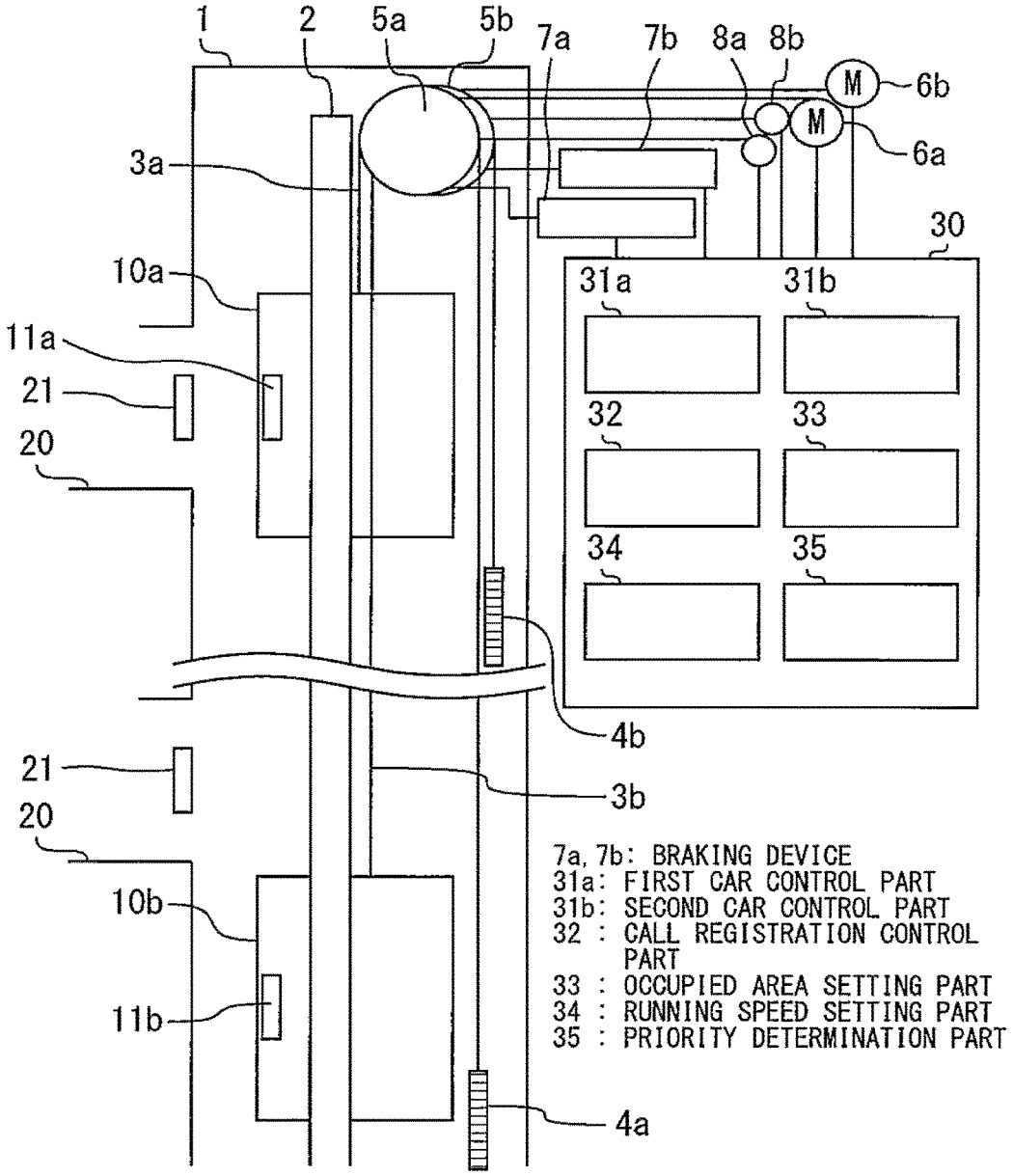
FIG. 1 is a front view of elevator doors equipped with an elevator door control device
Figure 2:
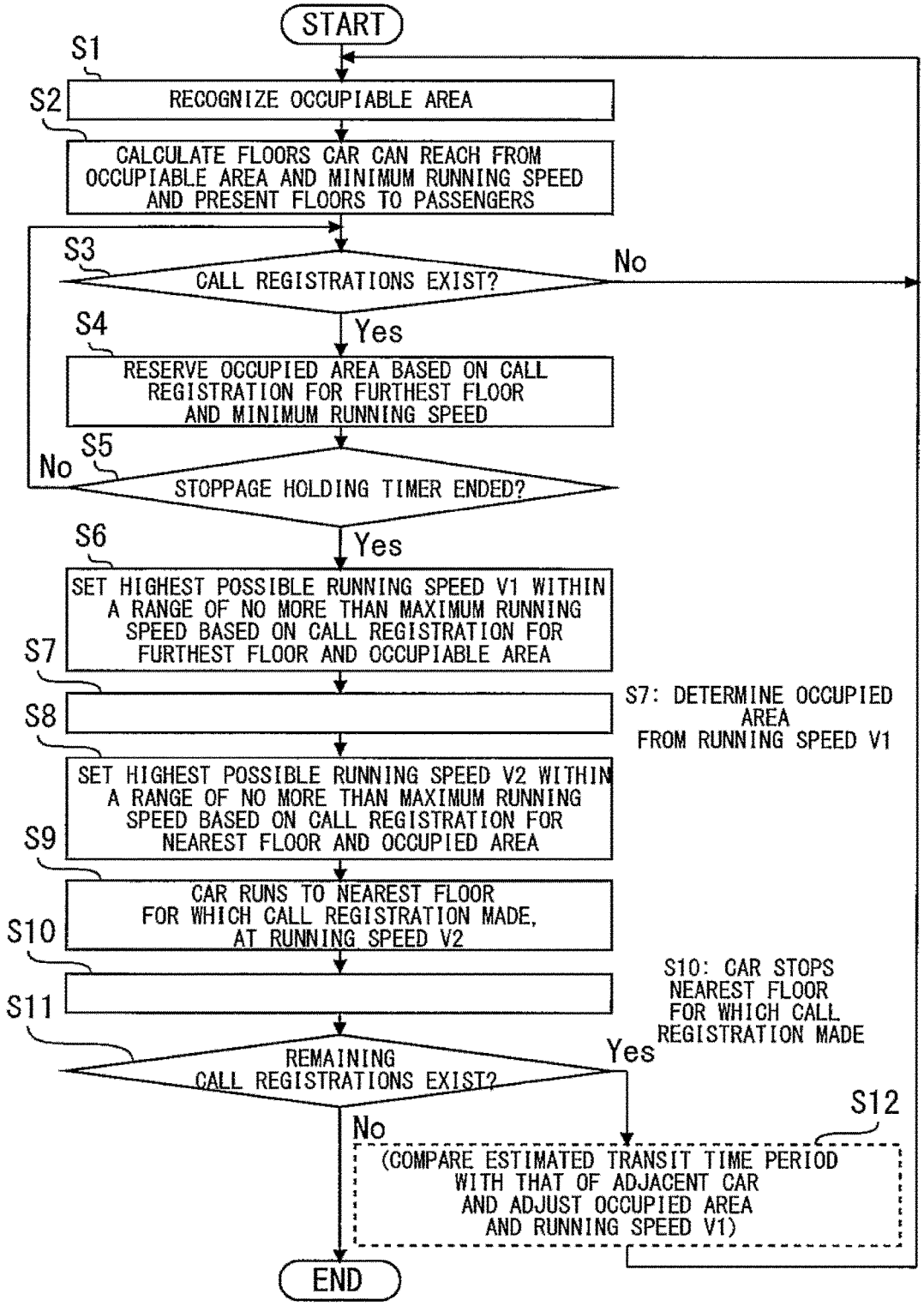
FIG. 2 is a flowchart illustrating operation of the elevator control device related to Embodiment 1 of the present invention.

FIGS. 1 and 2 relate to Embodiment 1 of this invention: FIG. 1 is a figure schematically illustrating an overall configuration of an elevator including an elevator control device; and FIG. 2 is a flowchart illustrating operation of the elevator control device.

As illustrated in FIG. 1, a pair of guide rails 2 is installed in a shaft 1 of an elevator. The guide rails 2 are arranged, vertically here, along a travelling path of the elevator. In the shaft 1, a first car 10*a* is installed. The first car 10*a* is guided by the guide rail 2 to ascend/descend in the shaft 1.

An end of a first main rope 3*a* is joined to an upper end of the first car 10*a*. Another end of the first main rope 3*a* is joined to an upper end of a first balancing weight 4*a*. The first balancing weight 4*a* is installed so as to freely ascend/descend inside the shaft 1.

An intermediate portion of the first main rope 3*a* is wound around a first driving sheave 5*a* installed at a top portion of the shaft 1. As described above, the first car 10*a* and the first balancing weight 4*a* are hung in a well bucket-like form in which the first car 10*a* and the first balancing weight 4*a* ascend/descend in directions opposite to each other by means of the first main rope 3*a* inside the shaft 1.

Inside the shaft 1, in addition to the first car 10*a*, a second car 10*b* is also installed. As with the first car 10*a*, the second car 10*b* is guided by the guide rails 2 to ascend/descend the shaft 1. An end of a second main rope 3*b* is joined to an upper end of the second car 10*b*. Another end of the second main rope 3*b* is joined to an upper end of a second balancing weight 4*b*. The second balancing weight 4*b* is installed so as to freely ascend/descend inside the shaft 1.

An intermediate portion of the second main rope 3*b* is wound around a second driving sheave 5*b* installed at the top portion of the shaft 1. As described above, the second car 10*b* and the second balancing weight 4*b* are hung in a well bucket-like form in which the second car 10*b* and the second balancing weight 4*b* ascend/descend in directions opposite to each other by means of the second main rope 3*b* inside the shaft 1.

The first car 10*a* is arranged on the upper side relative to the second car 10*b* inside the shaft 1. Therefore, the first car 10*a* is consistently located on the upper side relative to the second car 10*b* in the shaft 1. In other words, the second car 10*b* is consistently located on the lower side relative to the first car 10*a* in the shaft 1. As described above, an elevator to be controlled by the elevator control device according to this invention is what is called a one-shaft, multi-car type elevator in which a first car 10*a* and a second car 10*b*, which correspond to multiple cars, are provided inside a single common shaft 1 in such a manner that each of the first car 10*a* and the second car 10*b* can ascend/descend independently.

Each of multiple floors of a building at which the first car 10*a* and/or the second car 10*b* can stop, a hall 20 for users to board/alight the first car 10*a* and/or the second car 10*b* is provided. In each hall 20, a hall operating panel 21 is installed. In each hall operating panel 21, non-illustrated hall call buttons for registering a hall call for a direction a user desires (an up direction or a down direction) is provided. Upon any of the hall call buttons being operated, the hall operating panel 21 outputs an operation signal corresponding to the operated button.

In the car interior of the first car 10*a*, a first car operating panel 11*a* is installed. In the car interior of the second car 10*b*, a second car operating panel 11*b* is installed. In each of these car operating panels, non-illustrated car call buttons for a user in the relevant car to register a call for a desired destination floor is provided. Upon any of the car call buttons being operated, the relevant one of the first car operating panel 11*a* and the second car operating panel 11*b* outputs an operation signal corresponding to the operated button.

The first driving sheave 5*a* is driven by a first drive motor 6*a* to rotate. The second driving sheave 5*b* is driven by a second drive motor 6*b* to rotate. Also, a first braking device 7*a* applies a brake to rotation of the first driving sheave 5*a*. A second braking device 7*b* applies a brake to rotation of the second driving sheave 5*b*. Furthermore, a rotation frequency of the first driving sheave 5*a* is detected by a first encoder 8*a*. A rotation frequency of the second driving sheave 5*b* is detected by the second encoder 8*b*. Results of the detection by these encoders are output from the respective encoders as detection signals.

Operation of the elevator configured as described above is controlled by a control device 30. The control device 30 controls operation of the first car 10*a* and the second car 10*b* based on the button operation signals output from the respective operating panels, that are the hall operating panel 21, the first car operating panel 11*a* and the second car operating panel 11*b*, and the detection signals output from the first encoder 8*a* and the second encoder 8*b*.

The control device 30 can recognize respective positions, running directions and running speeds of the first car 10*a* and the second car 10*b* based on the detection signals from the first encoder 8*a* and the second encoder 8*b*.

The control device 30 includes a first car control part 31*a*, a second car control part 31*b*, a call registration control part 32, an occupied area setting part 33, a running speed setting part 34 and a priority determination part 35. The first car control part 31*a* controls operation of the first drive motor 6*a* and the first braking device 7*a*, thereby controlling running of the first car 10*a*. The second car control part 31*b* controls operation of the second drive motor 6*b* and the second braking device 7*b*, thereby controlling running of the second car 10*b*.

Here, where the first car 10*a* and the second car 10*b* come abnormally close to each other or these cars come abnormally close to a terminal of the shaft 1, the first car control part 31*a* and the second car control part 31*b* put an emergency brake on the cars. Also, upon detection of a failure of the equipment or occurrence of a disaster such as an earthquake or a fire, also, the first car control part 31*a* and the second car control part 31*b* may put an emergency brake on the cars.

The call registration control part 32 controls call registrations for the first car 10*a* and the second car 10*b* based on the operation signals from the respective operating panels. The call registration control part 32 registers directions or calls for destination floors according to the operated buttons in the respective operating panels.

The first car control part 31*a* and the second car control part 31*b* control running of the first car 10*a* and the second car 10*b*, respectively, based on statuses of calls registered by the call registration control part 32.

For each of the first car 10*a* and the second car 10*b*, the occupied area setting part 33 sets a maximum area of a travel section necessary for the car to make an emergency stop as an occupied area for the car, based on the running speed, the running direction and the call registration status.

For each of the first car 10*a* and the second car 10*b*, the running speed setting part 34 sets a running speed of the relevant car so that the number of floors the car can service is maximized within an area in which the car can make an emergency stop without entering an occupied area set by the occupied area setting part 33 for the other car.

The setting of the running speeds of the first car 10*a* and the second car 10*b* by the running speed setting part 34 and the setting of the occupied areas for the first car 10*a* and the second car 10*b* by the occupied area setting part 33 will be described in detail below. First, the running speeds of the first car 10*a* and the second car 10*b* set by the running speed setting part 34 are limited so as to be within a range of no less than a predetermined minimum running speed $v_{min}$ and no more than a predetermined maximum running speed $v_{max}$.

The occupied area setting part 33 is consistently monitoring a running speed, a running direction and a call registration status, and an occupied area setting status for each of the first car 10*a* and the second car 10*b* in operation. Then, based on results of the monitoring, the occupied area setting part 33 recognizes a maximum area that a car can occupy during stoppage of the car (hereinafter referred to as "occupiable area"). The occupiable area is a maximum area in which the car reaches neither the occupied area for the other car nor a terminal of the shaft 1.

Next, the running speed setting part 34 sets the running speed of the car to the minimum running speed $v_{min}$ so that the number of floors the car can service is maximized within a range in which the car can make an emergency stop without entering the occupied area for the other car.

The call registration control part 32 recognizes floors at which the car can stop at the time of emergency braking within the occupiable area for the car where the car runs at the running speed (minimum running speed $v_{min}$) set by the running speed setting part 34 and the car can stop by means of normal deceleration means, as floors the car can service.

In each of the first car operating panel 11*a* and the second car operating panel 11*b*, display means is provided. The respective display means display the floors the respective cars can service at the running speeds set by the running speed setting part 34 for the first car 10*a* and the second car 10*b*, to users.

More specifically, the display means can be provided by, for example, blinking button lamps of car call buttons for the floors the respective cars can service. Alternatively, separately from the car operating panels, indication devices each including, for example, a liquid-crystal display can be provided inside the respective cars. Users can be informed of floors the respective cars can service by display on such respective display means.

The control device 30 waits until a destination floor is registered by a user. Even during the wait, the control device 30 continues monitoring whether or not there is any change in operation condition of the other car. If there is a change in operation condition of the other car during the wait, the occupied area setting part 33 re-recognizes and updates the occupiable area for the car. If the occupiable area for the car is updated, the call registration control part 32 updates the information on the floors the car can service. If the information on the floors the car can service is updated, the display of the floors the car can service on the display means is also updated.

If an operation signal representing a floor the car can service as a destination floor is input, the call registration control part 32 permits registration of a call for the destination floor. The second car control part 31*b* registers the call for the destination floor, registration of which has been permitted by the second car control part 31*b*. On the other hand, if an operation signal representing a floor the car cannot service is input, the call registration control part 32 does not permit registration of a call for the destination floor. A call for a floor, registration of which is not permitted, is not registered. Hereinafter, "call for a destination floor" may simply be referred to as "destination floor".

If a floor the car can service is registered as a destination floor by the call registration control part 32, the occupied area setting part 33 sets a reserved occupied area for the car. The reserved occupied area is determined based on a floor that is furthest from a current position of the car from among destination floors already registered for the car, and the minimum running speed $v_{min}$.

Upon lapse of a predetermined period of time with no additional destination floors registered after last destination floor registration, the occupied area setting part 33 determines the occupied area for the car. The occupied area is determined as follows.

First, the running speed setting part 34 calculates a highest running speed $v_1$ of the car within a range in which the car can stop within the occupiable area for the car if the car starts emergency braking before reaching the destination floor that is furthest from the current position of the car from among the destination floors already registered for the car. Here, as described above, the running speed of the car does not exceed the maximum running speed $v_{max}$. Therefore, a maximum value of the running speed $v_1$ for the car is the maximum running speed $v_{max}$.

Next, the occupied area setting part 33 determines an occupied are for the car based on the running speed $v_1$ calculated by the running speed setting part 34. More specifically, if the car starts emergency braking during running to the furthest destination floor at the running speed $v_1$, the occupied area setting part 33 determines a maximum area for a travel section necessary for the car to stop, as the occupied area for the car.

Subsequently, the first car control part 31*a* makes first car 10*a* run so as to respond to each of the calls registered by the call registration control part 32. Likewise, the second car control part 31*b* makes the second car 10*b* run. The running speeds of the cars in this situation are determined by the running speed setting part 34.

In other words, each time the car stops, the running speed setting part 34 sets a highest speed within a range in which if the car starts emergency braking before reaching the next service floor, the car can stop without entering the occupied area for the other car set by the occupied area setting part 33, as a running speed $v_2$ of the car. Here, as with the running speed $v_1$, the running speed $v_2$ is within the range of no less than the minimum running speed $v_{min}$ and no more than the maximum running speed $v_{max}$.

As described above, the running speed $v_2$ of each of the first car 10*a* and the second car 10*b* is set to a highest speed within a range in which the relevant car is unlikely to enter the occupied area for the other car in the event of an emergency braking, each time the car make a run. Then, the first car control part 31*a* and the second car control part 31*b* controls running of the first car 10*a* and the second car 10*b*, respectively, according to the running speeds $v_2$ set by the running speed setting part 34 as described above.

If only one destination floor is registered for a certain car, the running speed $v_2$ of the car during actually running to the destination floor is equal to the running speed $v_1$, which is used for determination of the occupied area for the car.

Here, focusing on either of the first car 10*a* or the second car 10*b*, the running speed and the occupied area ultimately set for the car may be different depending on whether the setting of the running speed and the occupied area is made before or after the setting for the other car.

Therefore, the control device 30 includes a priority determination part 35. During stoppage of either of the first car 10*a* or the second car 10*b*, the priority determination part 35 determines a priority for each of the cars. More specifically, first, during stoppage of a car, the priority determination part 35 calculates an estimated time period of transit in a current running direction of each of the stopped car and a car adjacent to the car using call registration statuses of the cars.

Next, the priority determination part 35 determines a priority for each of the relevant car and the car adjacent to the car based on the calculated estimated transit time periods. Then, running speed setting part 34 preferentially sets a running speed of the car whose priority determined by the priority determination part 35 is higher from among the first car 10*a* and the second car 10*b*.

The flow of operation of an elevator control device configured as described above will be described with reference to the flowchart in FIG. 2.

First, in step S1, during stoppage of a car, the occupied area setting part 33 recognizes an occupiable area for the car. Then, the operation proceeds to step S2.

In step S2, first, the running speed setting part 34 sets a running speed of the car to a minimum running speed $v_{min}$ so that the number of floors the car can service is maximized within a range in which the car can make an emergency stop without entering an occupied area for the other car. Next, the call registration control part 32 determines floors the car can service based on the minimum running speed $v_{min}$ set by the running speed setting part 34 and the occupiable area for the car. Then, the display means displays the floors the car can service to users. After step S2, the operation proceeds to step S3.

In step S3, if there are no calls registered by the call registration control part 32 for the car, the operation returns to step S1. On the other hand, if there are calls registered by the call registration control part 32 for the car, the operation proceeds to step S4.

In step S4, the occupied area setting part 33 reserves an occupied area determined based on registration of a call for a floor that is furthest from a current car position of the car and the minimum running speed $v_{min}$ set by the running speed setting part 34. Then, the operation proceeds to step S5.

In step S5, if a stoppage holding timer has not yet ended, the operation returns to step S3. The stoppage holding timer is intended to measure wait time for a user to perform an operation to register a destination floor. If the stoppage holding timer has ended, the operation proceeds to step S6.

In step S6, the running speed setting part 34 sets a highest possible running speed $v_1$ of the car within a range of no more than a maximum running speed $v_{max}$ based on the floor for which call registration has been made, the floor being is furthest from the current position of the car, and the occupiable area for the car. Then, the operation proceeds to step S7.

In step S7, next, the occupied area setting part 33 determines an occupied area for the car based on the running speed $v_1$ set in step S6. Then, the operation proceeds to step S8.

In step S8, the running speed setting part 34 sets a highest possible running speed $v_2$ of the car within a range of no more than a maximum running speed $v_{max}$ based on a nearest floor for which call registration has been made, that is, a next service floor for the car, and the occupied area for the other car. Then, the operation proceeds to step S9.

In step S9, the first car control part 31*a* or the second car control part 31*b* makes the car run to the nearest floor for which call registration has been made, that is, the next service floor for the car, at the running speed $v_2$ set in step S8. Then, the operation proceeds to step S10.

In step S10, the car stops the next service floor, which is the nearest floor for which call registration has been made. Then, the operation proceeds to step S11.

In step S11, the control device 30 recognizes whether or not there are remaining call registrations for the car. If there are no remaining call registrations for the car, the series of operation flow ends.

On the other hand, in step S11, if there are remaining call registrations for the car, the operation proceeds to step S12. In step S12, first, the priority determination part 35 calculates an estimated transit time period for each of the stopped car and the car adjacent to the car. Next, the priority determination part 35 compares the estimated transit time periods calculated for these cars to determine priorities of the cars.

Then, the running speed setting part 34 sets a running speed $v_1$ of a car whose priority determined by the priority determination part 35 is higher, first. The occupied area setting part 33 determines an occupied area for the car whose running speed $v_1$ has been set by the running speed setting part 34. Subsequently, setting of a running speed $v_1$ and an occupied area for a car whose priority is lower is made in a manner that is similar to the above. After step S12, the operation returns to step S1.

Here, if multiple calls have been registered for a certain car, when the car stops at a floor at a position that is short of a final destination floor, the occupied area setting part 33 may re-set the occupied area so that the side of the occupied area opposite to the final destination floor side relative to the current position of the car becomes smaller. Consequently, the occupied area on the side opposite to the travelling direction of the car can be narrowed, enabling expansion of the occupiable area for the adjacent car. Also, an occupiable area for a car is updated each time the car stops, enabling optimization of the running speed $v_1$ and the occupied area for the car.

Furthermore, where cars run in directions in which the cars come close to each other, running speeds $v_1$ and occupied areas of the respective cars may be updated as follows. In other words, first, for each car, the control device 30 calculates an estimated running distance from a call registration status. Next, for each car, the control device 30 calculates an estimated transit time period from the calculated estimated running distance, the number of floors the car is supposed to stop at and the running speed $v_1$. Then, the control device 30 calculates a difference in estimated transit time period between the cars that come close to each other.

If the difference in estimated transit time period is not less than a predetermined reference value, the running speed setting part 34 and the occupied area setting part 33 re-set the running speeds $v_1$ and the occupied areas for the respective cars so that the difference in estimated transit time period between the cars becomes small. This re-setting is made when the respective cars stop. Consequently, the transit time periods of the respective cars are averaged, enabling enhancement in overall operation efficiency.

The elevator control device configured as described above includes: an occupied area setting part 33 that, for each of multiple cars arranged so as to be able to ascend/descend independently within a common shaft, sets a maximum area of a travel section that is necessary for the car to make an emergency stop as an occupied area for the car, based on a running speed, a running direction and a call registration status; and a running speed setting part 34 that sets a running speed of a car so that the number of floors the car can service is maximized within a range the car can make an emergency stop without entering the occupied area set by the occupied area setting part 33 for the other car.

Therefore, as a result of avoiding a collision between multiple cars that ascend/descend inside a common shaft and setting a running speed of a car so that the number of floors the car can service is maximized, the number of floors a user can select as a destination floor is increased, enabling enhancement in serviceability.

Also, the running speed setting part 34 calculates a highest running speed for a car within a range in which if the car starts emergency braking before reaching a furthest destination floor registered for the car, the car can stop without entering the occupied area set by the an occupied area setting part 33 for the other car. Then, the occupied area setting part 33 sets an occupied area for the car based on the highest running speed of the car, which has been calculated by the running speed setting part 34.

Thus, the car can be made to operate at the highest running speed within a range in which a collision with the other car can be avoided, according to registered destination floors, enabling suppression of operation efficiency decrease due to running speed decrease.

Furthermore, each time a car stop, the running speed setting part 34 sets a highest speed within a range in which the car can stop without entering the occupied area set by the occupied area setting part 33 for the other car if the car starts emergency braking before the car reaches a next service floor, as a running speed of the car. As described above, setting a running speed for each run enables optimization of the running speed according to change in status.

In addition, the elevator control device further includes the priority determination part 35 that during stoppage of a car, calculates estimated time periods of transit of the stopped car and a car adjacent to the stopped car in respective current running directions using call registration statuses of the stopped car and the car adjacent to the stopped car, and determines priorities of the stopped car and the car adjacent to the stopped car based on the calculated estimated transit time periods, and the running speed setting part 34 preferentially sets a running speed of a car whose priority determined by the priority determination part 35 is higher. Therefore, running speeds of the respective cars can be set so that the overall final operation efficiency is optimized.

INDUSTRIAL APPLICABILITY

This invention can be used for a control device for an elevator including multiple cars arranged inside a common shaft in such a manner that each car can ascend/descend independently.

Description Of Symbols

1 shaft, 2 guide rails, 3*a* first main rope, 3*b* second main rope, 4*a* first balancing weight, 4*b* second balancing weight, 5*a* first driving sheave, 5*b* second driving sheave, 6*a* first drive motor, 6*b* second drive motor, 7*a* first braking device, 7*b* second braking device, 8*a* first encoder, 8*b* second encoder, 10*a* first car, 10*b* second car, 11*a* first car operating panel, 11*b* second car operating panel, 20 hall, 21 hall operating panel, 30 control device, 31*a* first car control part, 31*b* second car control part, 32 call registration control part, 33 occupied area setting part, 34 running speed setting part, 35 priority determination part

The invention claimed is:

1. An elevator control device comprising:

multiple cars arranged inside a common shaft in such a manner that each car can ascend/descend independently;

an occupied area setting part configured to set, for each of the multiple cars, a maximum area of a travel section necessary for the car to make an emergency stop as an occupied area for the car, based on a running speed, a running direction and a call registration status; and a running speed setting part configured to set a running speed of a car so that the car can service a maximum number of individual floors without entering the occupied area set by the occupied area setting part for another car.

2. The elevator control device according to claim 1, further comprising call registration control part configured to permit registration of a call for a floor the car can service at the running speed set by the running speed setting part for the car as a destination floor.

3. The elevator control device according to claim 1, further comprising a display configured to display a floor the car can service at the running speed set by the running speed setting part for the car, to a user.

4. The elevator control device according to claim 1, wherein the running speed setting part calculates a highest running speed of the car within a range in which if the car starts emergency braking before reaching a furthest destination floor registered for the car, the car can stop without entering the occupied area set by the occupied area setting part for the other car; and wherein the occupied area setting part sets the occupied area for the car based on the highest running speed of the car, the highest running speed being calculated by the running speed setting part.

5. The elevator control device according to claim 1, wherein each time the car stops, the running speed setting part sets a highest speed within a range in which if the car starts emergency braking before reaching a next service floor, the car can stop without entering the occupied area set by the occupied area setting part for the other car, as the running speed of the car.

6. The elevator control device according to claim 1, comprising priority determination part configured to calculate, during stoppage of the car, estimated time periods of transit of the stopped car and a car adjacent to the stopped car in respective current running directions, using call registration statuses of the stopped car and the car adjacent to the stopped car, and determine priorities of the stopped car and the car adjacent to the stopped car based on the calculated estimated transit time periods, wherein the running speed setting part preferentially sets the running speed of a car whose priority determined by the priority determination part is higher.

7. The elevator control device according to claim 1, wherein the running speed setting part sets the running speed of the car within a range of no less than a predetermined minimum speed and no more than a predetermined maximum speed.

* * * * *